US006031175A

United States Patent [19]

Tozuka

[11] Patent Number: 6,031,175

[45] Date of Patent: Feb. 29, 2000

[54] MUSIC PERFORMING APPARATUS CAPABLE OF CALLING REGISTRATIONS FOR PERFORMANCE AND COMPUTER READABLE MEDIUM CONTAINING PROGRAM THEREFOR

[75] Inventor: Akira Tozuka, Hamamatsu, Japan

[73] Assignee: Yamaha Corporation, Hamamatsu, Japan

[21] Appl. No.: 09/245,176

[22] Filed: Feb. 5, 1999

[30] Foreign Application Priority Data

Feb. 6, 1998 [JP] Japan ..... 10-039828

[51] Int. Cl.[7] ..... G10H 1/36; G10H 1/40

[52] U.S. Cl. ..... 84/610; 84/611; 84/DIG. 12

[58] Field of Search ..... 84/609–614, DIG. 12

[56] References Cited

U.S. PATENT DOCUMENTS 5,578,778 11/1996 Imaizumi .

*Primary Examiner*—Stanley J. Witkowski
*Attorney, Agent, or Firm*—Graham & James LLP

[57] ABSTRACT

A music performing apparatus comprises a manipulative music performing device which performs music according to the player's musical performance on the apparatus and an automatic accompaniment performing device which performs musical accompaniment according to automatic accompaniment signals provided in the apparatus. The properties and the manners of a musical performance and an automatic accompaniment are determined by the parameters set by the various controls such as switches and knobs in the control panel provided on the apparatus. A state of combination of such parameters is defined as a registration for a musical performance. Different registrations are stored in a data storage device representing different combinations of the parameters, and a desired one of the registrations is selectively called by the user to set the performance properties and manners. During the time the automatic accompaniment is running, when some registration is selected and the selected registration includes parameters related to the automatic accompaniment, such accompaniment-related parameters shall be excluded in setting the performance properties and manners, while the rest of the parameters are used to control the properties and manners of musical performance other than the automatic accompaniment part. Thus, inadvertent and unwilling changes in the automatic accompaniment can be avoided.

25 Claims, 7 Drawing Sheets

MUSIC PERFORMING APPARATUS CAPABLE OF CALLING REGISTRATIONS FOR PERFORMANCE AND COMPUTER READABLE MEDIUM CONTAINING PROGRAM THEREFOR

BACKGROUND OF THE INVENTION

1. Field of the Invention

The present invention relates to a music performing apparatus and method, and a computer readable medium, and more particularly to such a music performing apparatus and method, and a computer readable medium containing computer readable program instructions to configure a computer system to construct such a music performing apparatus or to perform processes for such a method in which a musical performance is conducted according to manipulative operations by a player together with an automatic accompaniment performance which is conducted according to automatically progressing rhythm signals in the properties and manners of performance as determined by the registration or set states of controls in the panel, and in which registrations are stored in a storage device and the player can selectively call any of the stored registrations to arbitrarily change registrations for the performance.

2. Description of the Prior Art

Music performing apparatuses such as electronic musical instruments are conventionally provided with plural control switches and knobs in the panel which respectively set respective parameters determining properties and manners of tone generation and accompaniment progression, and a musical performance is conducted according to such a panel set state. The panel set states may be arbitrarily changed by the user individually setting the respective parameters according to the user's intention, while some preset panel states are also prepared in the form of a combination of parameters (defined as a registration for a performance) having respective recommendable values for the performance. Such registrations are represented by data sets each indicating the parameter values defining each panel set state, and such registration data sets are stored in a storage device so that the player can call a desired registration from among the stored ones by manipulating a registration call switch (a gang-setting preset switch). When a registration is called, the tone properties and controls, the accompaniment manners and styles and so forth are collectively set (changed) for the musical performance. On the music performing apparatus provided with such a registration call function, the player can perform music using various property controls and accompaniment manners as changed one after another by manipulating the registration call switch during the musical performance.

The registration data for such a registration call function, however, may include data for setting properties and manners of the accompaniment performance. Therefore, if the registrations are changed in the middle of the musical performance using an automatic accompaniment, the accompaniment will lack integrity and consistency, as the sections in the course of accompaniment, the split points for the chord key range, and the like may be altered during the accompaniment running. From this point of view, the registration should not be called anew at the time the automatic accompaniment is running.

In order to solve such a problem, there has been proposed a freeze function as disclosed in U.S. Pat. No. 5,578,778, in which particular parameters among the registration data are specifically frozen so as not to be used for alteration even when the registration is called. But such a freeze function needs troublesome setting for individual parameters to edit each freeze mode, and therefore it has been difficult for the user to understand the way of setting the freeze function and to actually set the same in the electronic musical instrument having such capability.

SUMMARY OF THE INVENTION

It is, therefore, a primary object of the present invention to provide a music performing apparatus in which the parameter settings related to an automatic accompaniment will not be altered, when a registration is called by the user in the middle of the music performance using the automatic accompaniment. A further object of the present invention is to provide a computer readable medium containing program instructions and registration data which will not alter the registration parameters related to the accompaniment when a registration is called anew during the musical performance using the automatic accompaniment.

According to one aspect of the present invention, the object is accomplished by providing a first type of music performing apparatus which comprises: a manipulative music performing device which performs music according to manipulative operations by a user to play music on the apparatus; an automatic accompaniment performing device which performs musical accompaniment according to automatically progressing rhythm signals; a data storage device which stores at least one registration data set each set including a first data subset which represents first parameters for defining registrations substantially related to musical performance other than the automatic accompaniment, and a second data subset which represents second parameters for defining registrations substantially related to the automatic accompaniment, the first parameters substantially determining properties and manners of musical performance other than the automatic accompaniment and the second parameters substantially determining properties and manners of automatic accompaniment; a parameter supplying device which supplies the first and second parameters to the manipulative music performing device and the automatic accompaniment performing device, respectively, to render the manipulative music performing device operative to perform music with the properties and manners determined by the first parameters, and to render the automatic accompaniment performing device operative to perform musical accompaniment with the properties and manners determined by the second parameters; a judging device which judges whether an automatic accompaniment performance is now running or not; a registration call instructing device for inputting an instruction to selectively call one of the at least one registration data set; and a registration calling device which reads and sends the selected registration data set from the data storage device to the parameter supplying device upon instruction of the registration call, such that the registration calling device sends only the first data subset to the parameter supplying device, when the judging device judges that an automatic accompaniment performance is running now.

According to another aspect of the present invention, the object is accomplished by providing a second type of music performing apparatus which comprises: a manipulative music performing device which performs music according to manipulative operations by a user to play music on the apparatus; an automatic accompaniment performing device which performs musical accompaniment according to automatically progressing rhythm signals; a registration data setting device for setting at least one user-set registration data set by the user of the apparatus, each set including a first data subset which represents first parameters for defining registrations substantially related to musical performance other than the automatic accompaniment, and a second data subset which represents second parameters for defining registrations substantially related to the automatic accompaniment, the first parameters substantially determining properties and manners of musical performance other than the automatic accompaniment and the second parameters substantially determining properties and manners of automatic accompaniment; a data storage device which stores the at least one user-set registration data set which is set by the registration data setting device, and further stores at least one preset registration data set which is preset in the apparatus each set including a third data subset which represents third parameters for defining registrations substantially related to musical performance other than the automatic accompaniment, and a fourth data subset which represents fourth parameters for defining registrations substantially related to the automatic accompaniment, the third parameters substantially determining properties and manners of musical performance other than the automatic accompaniment and the fourth parameters substantially determining properties and manners of automatic accompaniment; a parameter supplying device which supplies the first and second parameters or the third and fourth parameters to the manipulative music performing device and the automatic accompaniment performing device, respectively, to render the manipulative music performing device operative to perform music with the properties and manners determined by the first or third parameters, and to render the automatic accompaniment performing device operative to perform musical accompaniment with the properties and manners determined by the second or fourth parameters; a registration call instructing device for inputting an instruction to selectively call one of the at least one user-set registration data set or the at least one preset registration data set; a judging device which judges whether the selectively called registration data set is a preset registration data set or not; and a registration calling device which reads and sends the selected registration data set from the data storage device to the parameter supplying device upon instruction of the registration call, such that the registration calling device sends the first and second data subsets to the parameter supplying device, when the judging device judges that the selectively called registration data set is not a preset registration data set.

According to a further aspect of the present invention, the object is accomplished by providing a third type of music performing apparatus which comprises: a manipulative music performing device which performs music according to manipulative operations by a user to play music on the apparatus; an automatic accompaniment performing device which performs musical accompaniment according to automatically progressing rhythm signals; a data storage device which stores at least one registration data set each set including a first data subset which represents first parameters for defining registrations substantially related to musical performance other than the automatic accompaniment, and a second data subset which represents second parameters for defining registrations substantially related to the automatic accompaniment, the first parameters substantially determining properties and manners of musical performance other than the automatic accompaniment and the second parameters substantially determining properties and manners of automatic accompaniment; a parameter supplying device which supplies the first and second parameters to the manipulative music performing device and the automatic accompaniment performing device, respectively, to render the manipulative music performing device operative to perform music with the properties and manners determined by the first parameters, and to render the automatic accompaniment performing device operative to perform musical accompaniment with the properties and manners determined by the second parameters; a mode setting device for selectively setting a call-inhibited mode in which the second data subset shall not be called; a judging device for judging whether the call-inhibited mode is set or not; a registration call instructing device for inputting an instruction to selectively call one of the at least one registration data set; and a registration calling device which reads and sends the selected registration data set from the data storage device to the parameter supplying device upon instruction of the registration call, such that the registration calling device sends the first and second data subsets to the parameter supplying device, when the judging device judges that the call-inhibited mode is not set.

According to still further aspect of the present invention, the object is accomplished by providing a fourth type of music performing apparatus which comprises: a manipulative music performing device which performs music according to manipulative operations by a user to play music on the apparatus; an automatic accompaniment performing device which performs musical accompaniment according to automatically progressing rhythm signals; a data storage device which stores at least one registration data set each set including a first data subset which represents first parameters for defining registrations substantially related to musical performance other than the automatic accompaniment, a second data subset which represents second parameters for defining registrations substantially related to the automatic accompaniment, and a data flag which indicates whether the second data subset shall be called or not, the first parameters substantially determining properties and manners of musical performance other than the automatic accompaniment and the second parameters substantially determining properties and manners of automatic accompaniment; a parameter supplying device which supplies the first and second parameters to the manipulative music performing device and the automatic accompaniment performing device, respectively, to render the manipulative music performing device operative to perform music with the properties and manners determined by the first parameters, and to render the automatic accompaniment performing device operative to perform musical accompaniment with the properties and manners determined by the second parameters; a judging device for judging whether the data flag indicates that the second data subset shall be called or not; a registration call instructing device for inputting an instruction to selectively call one of the at least one registration data set; and a registration calling device which reads and sends the selected registration data set from the data storage device to the parameter supplying device upon instruction of the registration call, such that the registration calling device sends both the first and second data subsets to the parameter supplying device, when the judging device judges that the data flag indicates that the second data subset shall be called.

According to still further aspect of the present invention, the object is accomplished by providing a fifth type of music performing apparatus which comprises: a manipulative music performing device which performs music according to manipulative operations by a user to play music on the apparatus; an automatic accompaniment performing device which performs musical accompaniment according to automatically progressing rhythm signals; a data storage device which stores at least one registration data set each set including a first data subset which represents first parameters for defining registrations substantially related to musical performance other than the automatic accompaniment, a second data subset which represents second parameters for defining registrations substantially related to the automatic accompaniment, and a third data subset including data flags each of which corresponds to each of the second parameters and indicates whether the corresponding parameter shall be called or not, the first parameters substantially determining properties and manners of musical performance other than the automatic accompaniment and the second parameters substantially determining properties and manners of automatic accompaniment; a parameter supplying device which supplies the first and second parameters to the manipulative music performing device and the automatic accompaniment performing device, respectively, to render the manipulative music performing device operative to perform music with the properties and manners determined by the first parameters, and to render the automatic accompaniment performing device operative to perform musical accompaniment with the properties and manners determined by the second parameters; a judging device for judging whether each the data flag indicates that each the corresponding second parameter shall be called or not; a registration call instructing device for inputting an instruction to selectively call one of the at least one registration data set; and a registration calling device which reads and sends the selected registration data set from the data storage device to the parameter supplying device upon instruction of the registration call, such that the registration calling device sends to the parameter supplying device both the first and second data subset, when the judging device judges that none of the data flags indicate that the corresponding second parameter shall not be called.

Any of the above-described types of music performing apparatus can be constructed by employing a computer system such that some or all of the respective mentioned element devices are constituted by configuring the computer system to perform the respective mentioned functions according to computer program instructions.

For any of the above-described types of music performing apparatus, what is useful will be a machine readable medium containing the above-described respective registration data sets to be transferred to the data storage device comprised in the apparatus.

For example, for the above-mentioned fourth type of music performing apparatus, what is useful will be a machine readable medium containing plural registration data sets each set including a first data subset which represents first parameters for defining registrations substantially related to musical performance other than the automatic accompaniment, a second data subset which represents second parameters for defining registrations substantially related to the automatic accompaniment, and a data flag which indicates whether the second data subset shall be called or not, wherein the first parameters substantially determine properties and manners of musical performance other than the automatic accompaniment and the second parameters substantially determine properties and manners of automatic accompaniment.

For example, for the above-mentioned fifth type of music performing apparatus, what is useful will be a machine readable medium containing plural registration data sets each set including a first data subset which represents first parameters for defining registrations substantially related to musical performance other than the automatic accompaniment, a second data subset which represents second parameters for defining registrations substantially related to the automatic accompaniment, and a third data subset including data flags each of which corresponds to each of the second parameters and indicates whether the corresponding parameter shall be called or not, wherein the first parameters substantially determine properties and manners of musical performance other than the automatic accompaniment and the second parameters substantially determine properties and manners of automatic accompaniment.

According to still further aspect of the present invention, the object is accomplished by providing a machine readable medium containing program instructions for use in a computer system to configure the computer system upon being read and executed by the computer system to perform the processes of: providing a manipulative music performing device which performs music according to manipulative operations by a user to play music on the computer system; providing an automatic accompaniment performing device which performs musical accompaniment according to automatically progressing rhythm signals; storing at least one registration data set each set including a first data subset which represents first parameters for defining registrations substantially related to musical performance other than the automatic accompaniment, and a second data subset which represents second parameters for defining registrations substantially related to the automatic accompaniment, the first parameters substantially determining properties and manners of musical performance other than the automatic accompaniment and the second parameters substantially determining properties and manners of automatic accompaniment; supplying the first and second parameters to the manipulative music performing device and the automatic accompaniment performing device, respectively, to render the manipulative music performing device operative to perform music with the properties and manners determined by the first parameters, and to render the automatic accompaniment performing device operative to perform musical accompaniment with the properties and manners determined by the second parameters; judging whether an automatic accompaniment performance is now running or not; providing a registration call instructing device for inputting an instruction to selectively call one of the at least one registration data set according to the user's selection; and reading and sending the selected registration data set from the data storage device to the parameter supplying process upon instruction of the registration call, such that the first data subset is supplied to the manipulative music performing device only and that the second data subset is not supplied to the automatic accompaniment performing device, when the judging process judges that an automatic accompaniment performance is running now.

According to the above-described first type of music performing apparatus, when a registration is called form among the stored registrations during the time the automatic accompaniment is running, the parameters related to the automatic accompaniment will be automatically excluded from being supplied to the automatic accompaniment performing device and only the parameters related to the musical performance other than the automatic accompaniment will be supplied to the manipulative music performing device. Therefore, even though the player might call a registration in the middle of a performance using the automatic accompaniment function, inadvertent and unwilling alteration of parameters related to the automatic accompaniment will be avoided with no need of troublesome operations.

According to the above-described second through fifth types of music performing apparatus, the use of the accompaniment-related parameters may be previously prohibited with respect to the preset registrations only or the prohibition of the use of the accompaniment-related parameters may be selectively determined by the player. Or the information for prohibiting the use of the accompaniment-related parameters is included in the registration data sets, or the data flags for indicating the prohibition of the use of the accompaniment-related parameters are individually included in the registration data sets, and the use of the respective parameters are determined in accordance with such information and data flags. Therefore, the player can enjoy a performance with precisely wanted panel settings by merely calling a registration during the musical performance.

The machine readable medium containing registration data sets includes a data flag indicating whether the second parameters shall be called or not or data flags each indicating whether each of the second parameter shall be called or not, and therefore the accompaniment-related parameters can be collectively or individually prohibited as desired when a registration in called by the player. This permits an automatic judgment whether to call the accompaniment-related parameters or not collectively or individually when the automatic accompaniment is running on the apparatus, as the player merely sets the medium containing the registration data to the music performing apparatus and merely instructs to call any intended registrations from among the recorded registrations on the medium. Thus, the player can enjoy a musical performance under any desired panel settings as the player calls desired registrations from the recorded medium of this invention containing various registrations.

BRIEF DESCRIPTION OF THE DRAWINGS

For a better understanding of the present invention, and to show how the same may be practiced and will work, reference will now be made, by way of example, to the accompanying drawings, in which.

DESCRIPTION OF THE PREFERRED EMBODIMENTS

Figure 1:
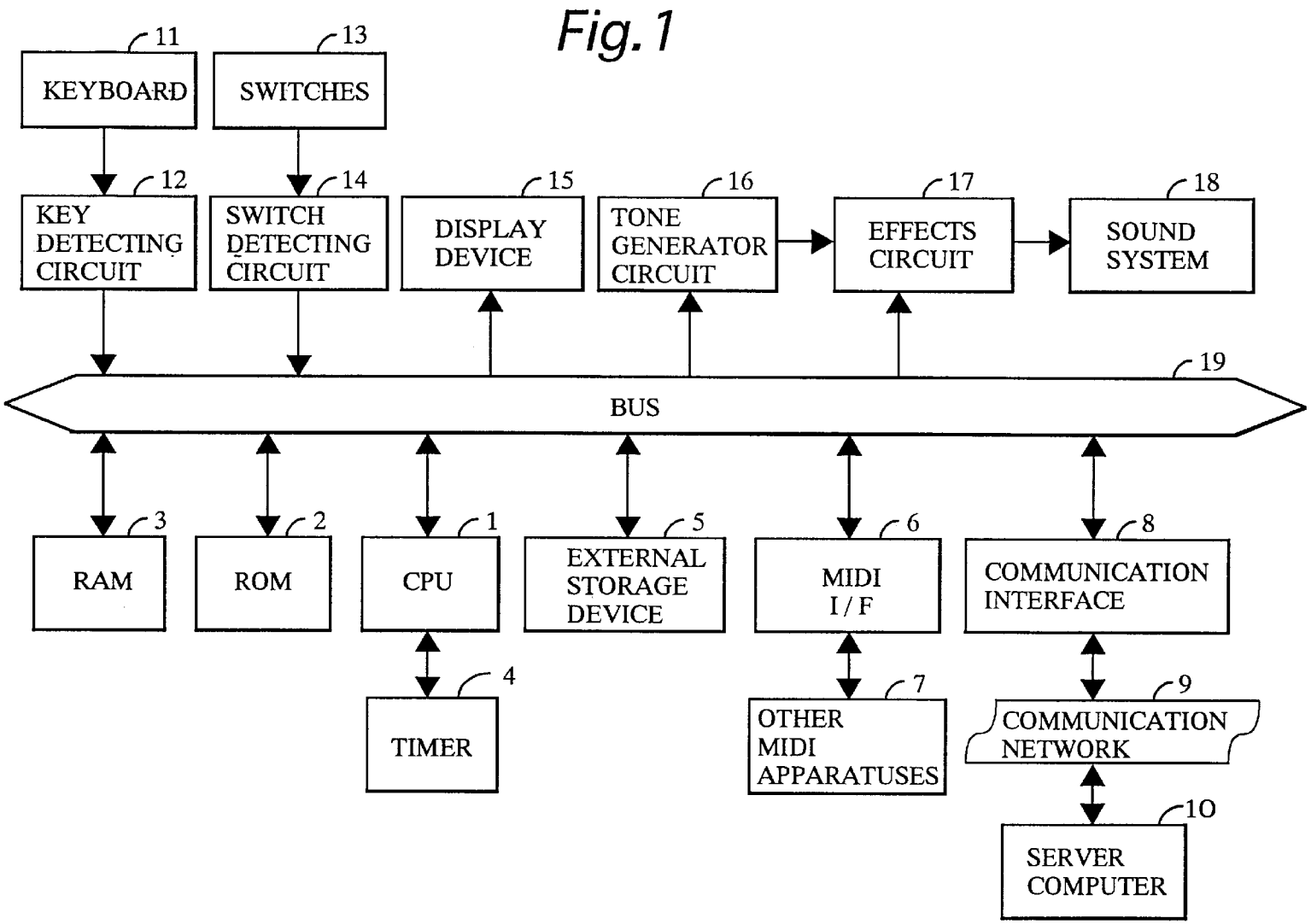
FIG. 1 is a block diagram showing an outline of an embodiment of a music performing apparatus of the present invention in a hardware structure.

Illustrated in FIG. 1 of the drawings is a block diagram showing an outline of the hardware structure of an embodiment of a music performing apparatus of the present invention.

In FIG. 1, a CPU (central processing unit) 1 is to control the overall operations of the apparatus, a ROM (read-only memory) 2 stores music and accompaniment performance programs executed by the CPU 1 and preset registration data to be called for the performance, a RAM 3 is to be used as a storing area for user-set registration data and a work area for the CPU 1, and a timer 4 is to count lapse time and to generate timer interruptions at a predetermined time interval and is used for the time control in the automatic accompaniment performance, the envelope formation, effects impartation and so forth. An external storage device 5 includes a hard disk drive (HDD), a floppy disk drive (FDD), and CD (compact disk)-ROM, a magneto-optical disk (MO), a digital versatile disk (DVD) for storing various programs such as music and accompaniment performance programs and various data such as registration data.

A MIDI interface (MIDI I/F) 6 is to transmit MIDI signals between the music performing apparatus of the present invention and other MIDI apparatuses 7 such as a sequencer and an electronic musical instrument handling MIDI format data signals. A communication interface 8 is to connect the music performing apparatus of the present invention with a server computer 10 via a communication network 9 including LAN (local area network) such as an Ethernet and a telephone line such as Internet so that the music performing apparatus may receive externally provided registration data, music performing programs and other application software.

A keyboard 11 is a manipulating device for a musical performance and includes music playing keys, and a key detecting circuit 12 detects key depression signals indicating the note-on and the note-off states and other data indicating the after-touch conditions under the manipulation of the keys to send to a bus 19 in the system. Switches 13 are provided, for example, in a control panel, and a switch detecting circuit 14 detects the switch information under the actuation of the switches 13 to send to the bus 19. A display device 15 is to display various information necessary for setting registration data and so forth by actuating the switches 13 and information related to a music performance while the music performance is running.

A tone generator circuit 16 generates musical tones based on tone control data stored in tone generation registers for a plurality of tone processing channels, and an effects circuit 17 is to impart various effects such as a reverberation effect, a chorus effect and a variation effect onto the tone data as generated by the tone generator circuit 16 based on effect control data for controlling effectors. A sound system 18 is to amplify analog tone signals outputted from the effects circuit 17 as converted into analog signals and to emit audible sounds. The bus 19 interconnects the respective element blocks in the system.

With the music performing apparatus as constructed as above, the properties and control manners of the musical tones for performance and the properties and manners of the musical accompaniment can be set by means the plurality of switches 13 provided in the control panel, and a musical performance can be conducted under such a condition as set according to the panel switch setting state, which is usually referred to as the registration for a musical performance. The panel setting states may be arbitrarily set by the user and so set states may be stored in the RAM 3 as registration data, and other panel setting states which are previously set in the music performing apparatus of the present invention are stored in the ROM 2 as registration data. The registration data indicating panel setting states and stored in the ROM 2 or in the RAM 3 can be called by manipulating a registration call switch among the switches 13 in the panel, whereupon the called data determine a panel setting state so that the musical performance is conducted under the so set panel setting state. Namely, a single manipulation of the registration call switch among the switches 13 can realize a desired panel setting state consisting of a combination of individual switch and control states in place of troublesome setting of a plurality of individual switches 13 in the panel.

The registration data can be generally classified into two categories, the data representing parameters for defining registrations substantially related to the ordinary manipulative musical performance other than the automatic accompaniment and the data representing parameters for defining registrations substantially related to the automatic accompaniment performance. The former parameters substantially determine the properties and manners of the musical performance other than the automatic accompaniment including the tone properties and the control manners, while the latter parameters substantially determine the properties and manners of the automatic accompaniment including the tone properties and the control manners. When the registration call switch among the panel switches 13 is actuated before a musical performance (or during a performance not using the automatic accompaniment function), all of the registration data are called to set all switches and controls in the panel to the state of a selected registration.

In the first type embodiment of the music performing apparatus according to the present invention, when the registration call switch 13 is actuated in the middle of a musical performance using the automatic accompaniment function, only the parameters related to the musical performance other than the automatic accompaniment are called for setting the panel condition, and the parameters related to the automatic accompaniment are automatically excluded (prohibited) from being called. Thus, by prohibiting the parameters related to the automatic accompaniment from being called in the middle of a music performance using the automatic accompaniment function, the panel setting state related to the automatic accompaniment, i.e. the panel registration determining the properties and manners of the automatic accompaniment will be maintained without being altered or affected, even when any registration is called during the performance employing the automatic accompaniment. Therefore, the player can enjoy a musical performance according to the panel setting state as desired for the ordinary performance by calling a desired registration in the middle of the musical performance employing the automatic accompaniment.

In the second type embodiment of the music performing apparatus according to the present invention, when the registration call switch 13 is actuated in the middle of a musical performance using the automatic accompaniment function, all of the registration data representing the parameters including those related to the automatic accompaniment will be called, if the called registration is a user-set registration which was set by the user by actuating the respective panel switches and stored in the RAM 3. On the other hand, if the called registration is a factory preset registration for the apparatus and is stored in the ROM 2, only the parameters related to the musical performance other than the automatic accompaniment are called for setting the panel condition, and the parameters related to the automatic accompaniment is prohibited from being called. In this way, by prohibiting the call of the parameters related to the automatic accompaniment only in the case of calling preset registration data, the player can enjoy a music performance under the particularly desired panel setting state by calling a desired registration in the middle of the performance employing the automatic accompaniment, which reflects the intention of the player more closely.

In the third type embodiment of the music performing apparatus according to the present invention, the user can set whether only the parameters related to a musical performance other than the automatic accompaniment shall be called or not, when the registration call switch 13 is actuated in the middle of a musical performance using the automatic accompaniment function. And where the user has set that only the data other than the parameters related to the automatic accompaniment shall be called, if the registration call switch 13 is actuated in the middle of a music performance using the automatic accompaniment, then only the parameters other than those related to the automatic accompaniment will be called and the parameters related to the automatic accompaniment will be prohibited. But, where the user has set that not only the accompaniment-unrelated parameters but all of the parameters shall be called, if the registration call switch 13 is actuated, then all of the registration data including the parameters related to the automatic accompaniment will be called. In this way, as the user can set whether the data other than the parameters related to the automatic accompaniment shall be called or not, the player can enjoy a music performance under the specifically desired panel setting state by calling a desired registration in the middle of the performance employing the automatic accompaniment, which closely reflects the intention of the player.

In the fourth type embodiment of the music performing apparatus according to the present invention, the registration data include a data flag for each registration data set to indicate whether only the data other than the parameters related to the automatic accompaniment shall be called or not, when the registration call switch 13 is actuated in the middle of a musical performance using the automatic accompaniment function. And where the data flag is set to indicate that only the data other than the parameters related to the automatic accompaniment shall be called, if the registration call switch 13 is actuated in the middle of a music performance using the automatic accompaniment, then only the parameters other than those related to the automatic accompaniment will be called and the parameters related to the automatic accompaniment will be prohibited. But, where the data flag is set to indicate that not only the data other than the accompaniment-related parameters but all of the parameters shall be called, if the registration call switch 13 is actuated, then all of the registration data including the parameters related to the automatic accompaniment will be called. As the data flag can be arbitrarily set by the user, the player can enjoy a music performance under the specifically desired panel setting state by calling a desired registration in the middle of the performance employing the automatic accompaniment.

In the fifth type embodiment of the music performing apparatus according to the present invention, the registration data include data flags each corresponding to each of the accompaniment-related parameters and indicating whether each corresponding accompaniment-related parameters shall be called or not, when the registration call switch 13 is actuated in the middle of a musical performance using the automatic accompaniment function. And therefore, when the registration call switch 13 is actuated in the middle of a music performance using the automatic accompaniment, then the parameters related to the automatic accompaniment other than those parameters of which the corresponding data flags are set not to call the respective parameters and all parameters related to musical performance other than the automatic accompaniment will be called, while the parameters whose corresponding data flags are set not to call the respective parameters related to the automatic accompaniment will be prohibited. As each data flag corresponding to each parameter among the accompaniment-related parameters can be arbitrarily set by the user, the player can enjoy a music performance under the specifically desired panel setting state by calling a desired registration in the middle of the performance employing the automatic accompaniment.

A plurality of registrations may be set, according to a program, to be called in a sequence one after another in the middle of the performance, so that the actuations of the registration call switch 13 can set one registration after another in the programmed order for the performance. Alternatively, a plurality of registration switches 13 may be provided corresponding to the respective ones of a plurality of registrations (panel setting states) so that the actuation of any of those registration switches 13 will call the registration which corresponds to the actuated call switch.

Figure 2:
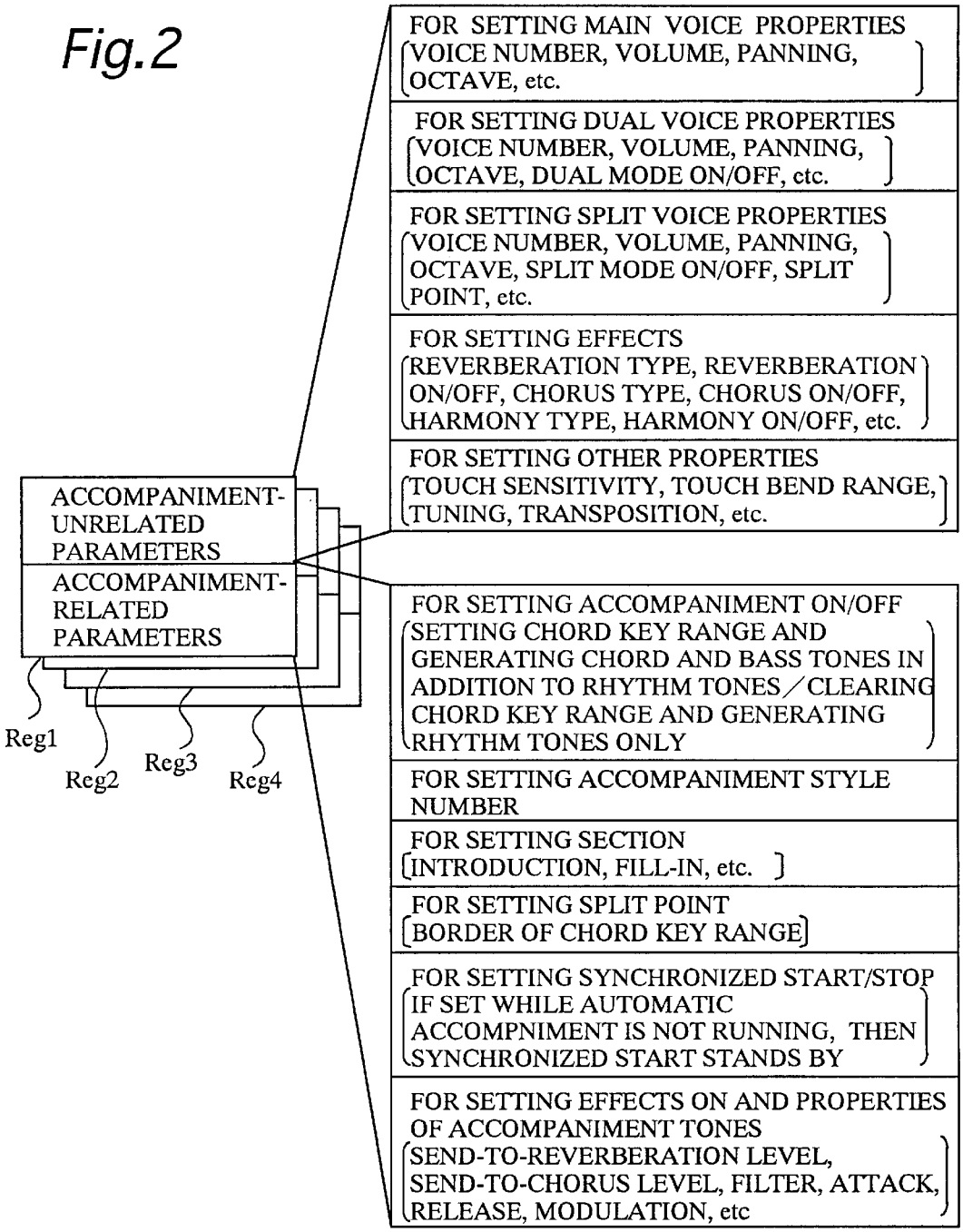
FIG. 2 is a chart showing the data structure of the registrations employed in the present invention.

FIG. 2 shows the details of the registrations composed of the parameters related to the musical performance other than the automatic accompaniment and the parameters related to the automatic accompaniment. Shown in FIG. 2 are four sets of registration data Reg1 through Reg4, each set including a like set of parameters. The player can selectively call any desired one from among these four registrations for applying to his/her performance. The contents of the registration data are explained hereunder with reference to the registration Reg1 as an example. The accompaniment-unrelated parameters, which is the parameters for defining registrations substantially related to (i.e. for substantially determining the properties and manners of) the musical performance other than the automatic accompaniment, are the main voice parameters for setting main voice properties, the dual voice parameters for setting dual voice properties, the split voice parameters for setting split voice properties, the effect parameters for setting effects and other parameters for setting other properties for the music performance.

The main voice parameters are comprised of parameters respectively indicating the voice number, the volume (tone intensity), the planning (sharing signal intensities between the L and R channels to locate the sounds in the stereophonic audio system), the octave, and so forth for the main voice. The dual voice parameters are parameters to determine the properties of the dual voice which is a secondary voice (tone) to the main voice (tone) when two tones are simultaneously generated under the condition of "dual mode on", and are comprised of parameters respectively indicating the voice number, the volume, the panning, the octave, the dual mode on/off, and so forth for the dual voice. Where the dual mode is set, the parameters for the primary voice are the main voice parameters.

The keyboard 11 is split in two key (note) ranges where the split mode is set "on". The tones generated in the lower key range are termed "split voices", while the tones generated in the higher key range are the main voices under the split mode, and the split voices and the main voices may be assigned with different tone properties such as tone colors. The split voice parameters to determine the properties of the split voice are comprised of parameters respectively indicating the voice number, the volume, the panning, the octave, the split mode on/off, the split point, and so forth for the split voice. Where the split mode is set, the parameters for the tones generated in the higher key range are the main voice parameters. The main voice parameters, the dual voice parameters and the split voice parameters are transmitted to the tone generation register in the tone generator circuit 16 for setting the tone generator circuit 16 to generate respective tone signals in the voices determined by these parameters.

The effect parameters which determines the properties and manners of effects to be imparted in the effects circuit 17 to the tone signals generated by the tone generator circuit 16 are comprised of parameters respectively indicating the reverberation type, the reverberation on/off, the chorus type, the chorus on/off, the harmony type, the harmony on/off, and so forth among the effects to be imparted to the tone signals. The other parameters are parameters respectively indicting the touch sensitivity, the touch bend range, the tuning, the transposition, and so forth for the performance.

The accompaniment-related parameters, which is the parameters for defining registrations substantially related to (i.e. for substantially determining the properties and manners of) the automatic accompaniment, are the accompaniment on/off parameter for setting whether to use the automatic accompaniment function, the style parameter for setting the accompaniment style number which designates the style (or genre) of the automatic accompaniment, the section parameter for setting the section such as the introduction, the fill-in, the main and the ending within the designated style to which the selected registration is to be applied, the split point parameter for setting the split point which is the border of the chord key range, the synchro parameter for setting the synchronized start/stop function in which the automatic accompaniment shall start upon first depression of any key in the keyboard 11 under the standby state, and the accompaniment tone control parameters for setting the effects on and properties of the accompaniment tones.

The accompaniment on/off parameter is a parameter to set whether chords and basses are to be generated in addition to the rhythm tones with the chord key range being designated or only rhythm tones are to be generated with the chord key range being cleared. When the synchro parameter indicating the use of the synchronized start/stop function is called while the automatic accompaniment is not running, the apparatus is set to the standby state for the synchronized start of the accompaniment. Among the accompaniment tone control parameters, there are parameters indicating the send-to-reverberation level (level of tone signals to be sent to the reverberation device), the send-to-chorus level (level of tone signals to be sent to the chorus effect imparting device), the filter factors, the attack level, the release level, the modulation degree, etc., and these parameters are provided for the bass channel, the chord channel and the rhythm channel separately to control the accompaniment tones in the respective channels individually.

Where the automatic accompaniment is performed according to the setting by the accompaniment related parameters, the keyboard 11 is divided into the chord key range and the ordinary key range at the split point so that chords are detected based on the depressed keys in the chord key range. The way of detecting chords may be the fingered chord mode in which chords are detected from the actually depressed chord constituent note keys or may be the single finger mode in which chords are detected from one through three (or more) keys as depressed according to a predetermined simple rules provided between the respective chords and the respective combination patterns of the depressed keys. Or alternatively, the chord detection mode may be a full keyboard mode in which chords are detected from the key depression states through the whole keyboard range without dividing into the chord key range and the ordinary key range. When the accompaniment-off condition is set, the chord detection will not take place. The automatic accompaniment will be started by the actuation of a rhythm start switch (although not shown), or by the depression of any key in the keyboard when the synchronized start mode is set. However, when the rhythm start switch is simply actuated, or when a key in the ordinary key range is depressed under the synchro-start mode, the automatic accompaniment will start with only the rhythm tones first, and thereafter when the keys in the chord key range are depressed, then the generation of the chord tones and/or the bass tones will start. On the other hand, when the first depression of keys is in the chord key range under the synchro-start mode, the chord part tones and/or the bass part tones will start from the beginning in addition to the rhythm tones. However, where the accompaniment-off mode is set, only the rhythm tones will be generated.

As is apparent from FIG. 2, there are provided a plurality of registration data sets Reg1 through Reg4 and the player can selectively call any of them to apply to his/her performance. Therefore, the ROM2 stores a number of accompaniment style data, among which the accompaniment style data corresponding to the selected style number will be read out and be used for conducting the automatic accompaniment performance. Each set of accompaniment style data is comprised of plural parts like a rhythm part, a chord part and a bass part, and is also comprised of plural sections like an introduction, a main, a fill-in, an ending, etc. To the accompaniment tones may also be imparted a reverberation effect, a chorus effect and so forth, and further the tone characteristics may also be controlled in terms of the filter characteristics and the envelope characteristics.

Figure 3:
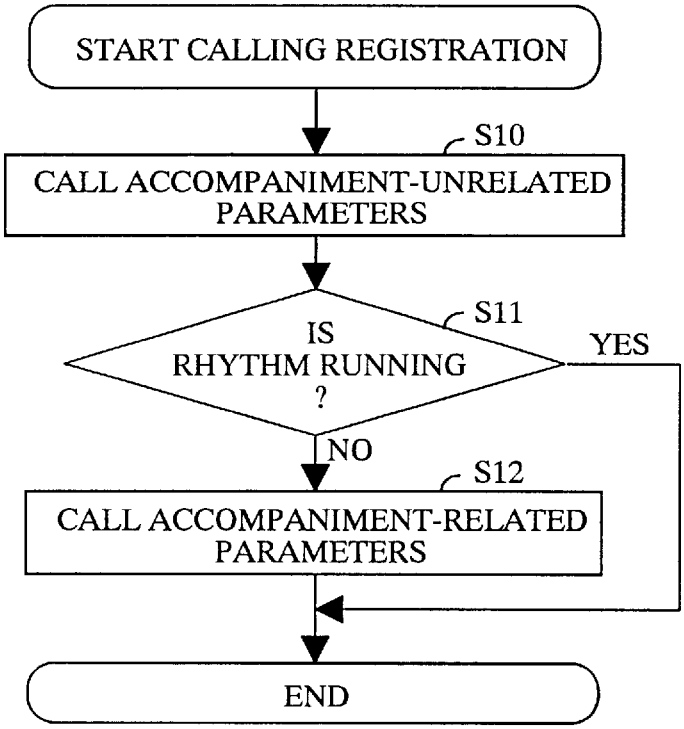
FIG. 3 is a flowchart showing the process of calling registrations in an embodiment of the first type of music performing apparatus according to the present invention.

Now a description will be made about the first-type embodiment of the music performing apparatus according to the present invention with reference to the flowchart of FIG. 3 showing the process of calling a registration. The actuation of the registration call switch among the switches 13 in the panel starts the process of calling a registration, and first a step S10 conducts the process of calling (reading out from the ROM 2 or the RAM 3 and setting the switches and controls accordingly) accompaniment-unrelated parameters, i.e. the parameters substantially determining properties and manners of a musical performance other than an automatic accompaniment. Next, a step S11 judges whether the automatic rhythm performance is running or not. If the automatic rhythm is running, the process of calling a registration goes to its end without calling the accompaniment-related parameters, whereas if the automatic rhythm is not running, the process moves forward to a step S12 to call the accompaniment-related parameters, i.e. the parameters substantially determining the properties and the manners of an automatic accompaniment performance, before ending the registration call processing.

Thus, in the middle of a music performance using the automatic accompaniment function, the accompaniment-related parameters will be prohibited from being called so that the panel setting state about the accompaniment-related switches and controls will not be changed, i.e. the properties and manners of the automatic accompaniment will be maintained without alteration, even though a registration is called anew during the music performance using the automatic accompaniment function. Therefore, the player can enjoy the music performance according to his/her intended panel setting state even by arbitrarily calling stored registrations during the performance employing the automatic accompaniment.

Figure 4A:
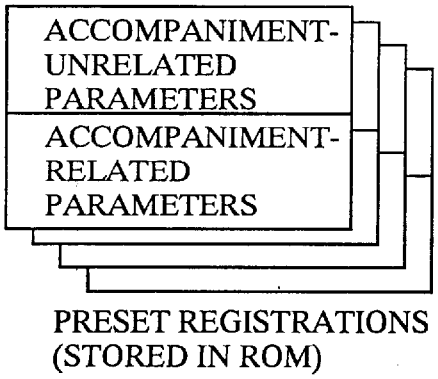
FIGS. 4(*a*) and 4(*b*) are charts respectively showing the preset registration data and the user-set registration data employed in an embodiment of the second type of music performing apparatus according to the present invention.
Figure 4B:
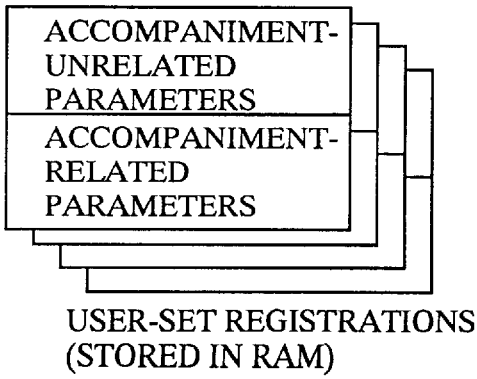
Figure 5:
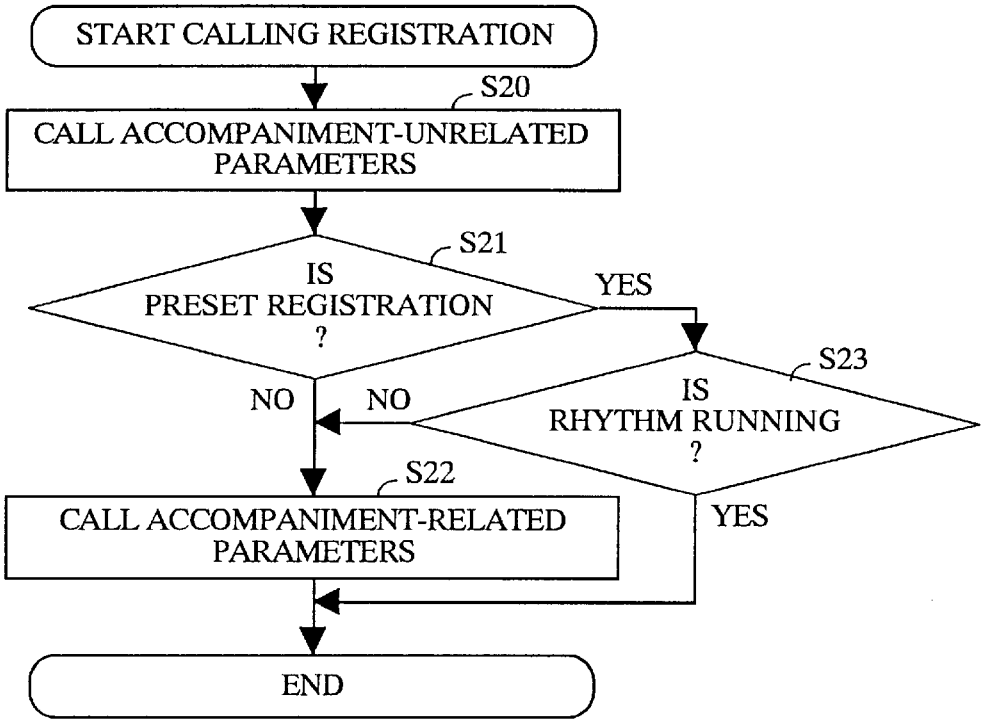
FIG. 5 is a flowchart showing the process of calling registrations in an embodiment of the second type of music performing apparatus according to the present invention.

Next, a description will be made about the second-type embodiment of the music performing apparatus according to the present invention with reference to the flowchart of FIG. 5 showing the process of calling a registration. The second-type embodiment, however, includes the preset-registrations as shown in FIG. 4(*a*) which are previously factory-set in the ROM 2 in the music performing apparatus and the user-set registrations as shown in FIG. 4(*b*) which have been set by the user according to the manipulation of plural switches 13 and are stored in the RAM 3. Each of the preset registrations and the user-set registrations includes accompaniment-unrelated parameters and accompaniment-related parameters as seen from these figures. From among these plural registrations, the player can selectively call any of the preset registrations and the user-set registrations to arbitrarily alter the panel setting state. Upon actuation of the registration call switch among the panel switches 13, the registration calling process starts and a step S20 calls an accompaniment-unrelated parameters. Next, a step S21 judges whether the called registration is a preset registration or not. Where the called registration is a preset registration stored in the ROM 2, the judgement answer is YES and the process flow branches to a step S23, which in turn judges whether the automatic rhythm (accompaniment) is running or not. If the automatic rhythm is running, the answer here will be YES, and the processing moves forward to an end to terminate the registration calling process without calling the accompaniment-related parameters. If the automatic rhythm is not running, the judgement answer will be NO, and the processing moves forward to a step S22, which in turn calls the accompaniment-related parameters, thereafter ending the registration call processing. On the other hand, when the step S21 judges that the called registration is a user-set registration stored in the RAM 3, the process moves forward to the step S22 to call the accompaniment-related parameters to thereafter terminate the registration calling processing.

Thus as explained above, during the performance employing the automatic accompaniment, the accompaniment-related parameters will be prohibited from being called only where the called registration is a preset registration so that the panel setting state related to the automatic accompaniment is maintained, even when a preset-registration may be called in the course of music performance using the automatic accompaniment. Therefore, the player can enjoy the music performance according to his/her intended panel setting state without suffering from inadvertent (unintended) changes in the panel setting, even by calling the stored registrations during the performance employing the automatic accompaniment.

Figure 6:
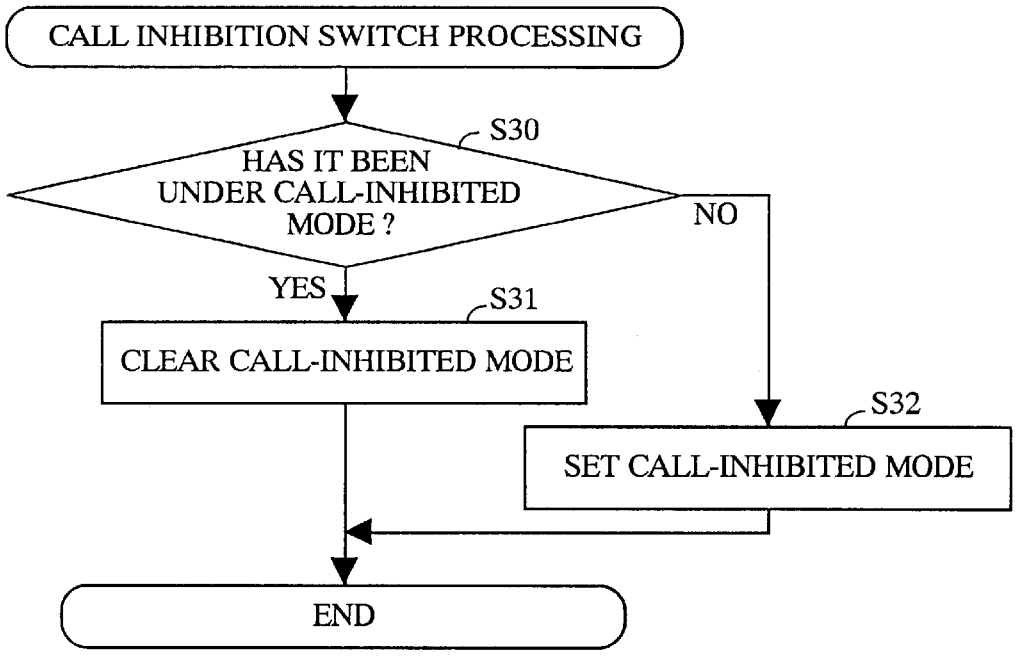
FIG. 6 is a flowchart showing the process of switching the call inhibition mode employed in an embodiment of the third type of music performing apparatus according to the present invention.

Next, a description will be made about the third-type embodiment of the music performing apparatus according to the present invention with reference to the flowcharts of FIGS. 6 and 7 respectively showing the processes of a call inhibition switch function and of a registration call function. In the third-type embodiment, the user is permitted to set whether only the data of accompaniment-unrelated parameters shall be called or not when a registration is called during the music performance using the automatic accompaniment. This setting according to the user's intention is conducted by the call inhibition switch processing. Upon actuation of the call inhibition switch provided among the panel switches 13 by the user, the call inhibition switch processing as shown in FIG. 6 is started. A step S30 judges whether or not it has been under the call-inhibited mode in which only the data of accompaniment-unrelated parameters shall be called when a registration is called during the music performance using the automatic accompaniment. If the step S30 judges that the present state is under the call-inhibited mode, the process moves forward to a step S31 to clear the call-inhibited mode, and the call inhibition switch processing comes to its end. On the other hand, if the step S30 judges that the present state is not under the call-inhibited mode, the process moves forward to a step S32 to set the call-inhibited mode, and the call inhibition switch processing comes to its end. In this way, every time the call inhibition switch is actuated, the states are alternately changed from the call-inhibited mode set state to the call-inhibited mode cleared state, and vice versa, thereby serving as a push-push change over switch for the user to arbitrarily set the intended one of the two states.

Figure 7:
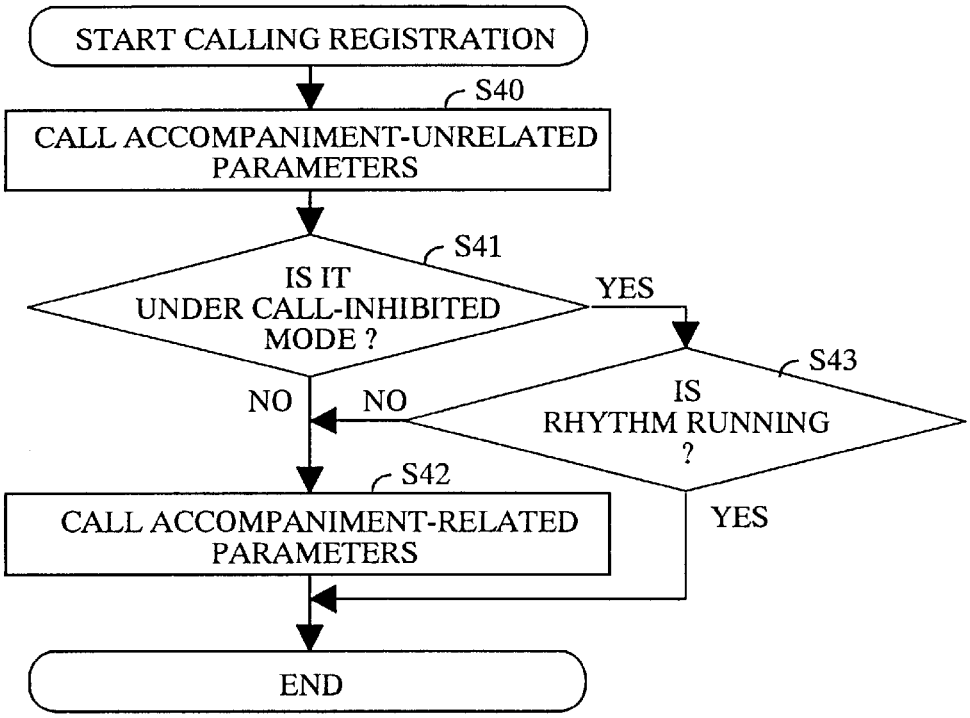
FIG. 7 is a flowchart showing the process of calling registrations in an embodiment of the third type of music performing apparatus according to the present invention.

Then, the actuation of the registration call switch 13 initiates the process of calling a registration (selectively from among the plural registrations provided) as shown in FIG. 7, wherein a step S40 calls the accompaniment-unrelated parameters. Thereafter, a step S41 judges whether or not the present state is under the call-inhibited mode in which only the data of accompaniment-unrelated parameters shall be called when a registration is called during the musical performance using the automatic accompaniment. Where the situation is under the call-inhibited mode, the judgement says YES and the process branches to a step S43 to judge whether the automatic rhythm (accompaniment) is running or not. If the rhythm is running, the judgement here says YES and as a result the process of calling a registration comes to its end without calling an accompaniment-related parameters. On the other hand if the rhythm is not running, the judgement at the step S43 says NO and as a result the process moves to a step S42 to call the accompaniment-related parameters, and thereafter the process of calling a registration comes to its end. If the step S41 judges that the call-inhibited mode has been cleared, the process moves directly to the step S42 to call the accompaniment-related parameters, and thereafter the process of calling a registration comes to its end.

Thus as explained above, during the musical performance using the automatic accompaniment, when the registration call switch 13 is actuated to selectively call a desired registration from among the stored plurality of registrations, only the data other than the accompaniment-related parameters are read out, if the user has set the call-inhibited mode, and the accompaniment-related parameters will not be called. Where the user has cleared the call-inhibited mode, both the accompaniment-unrelated parameters and the accompaniment-related parameters will be called whether the automatic accompaniment is being used or not. Thus, the user can selectively set whether to call only the data other than the accompaniment-related parameters or not, and accordingly the player can enjoy a music performance under his/her intended panel setting state while calling a registration during the performance using the automatic accompaniment.

Figure 8:
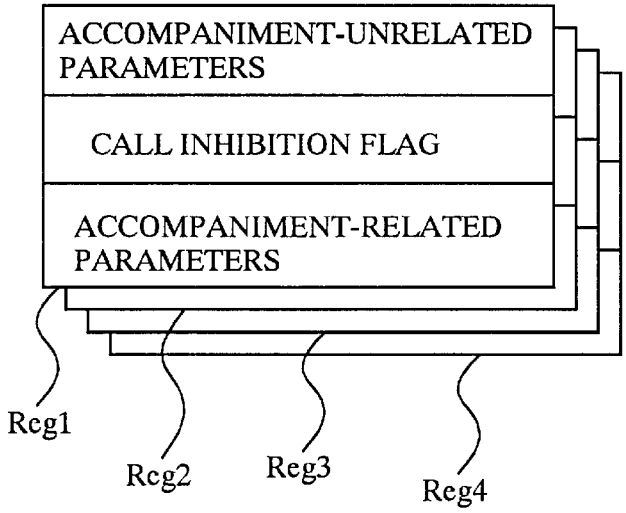
FIG. 8 is a chart showing the data structure of the registrations employed in an embodiment of the fourth type of music performing apparatus according to the present invention.
Figure 9:
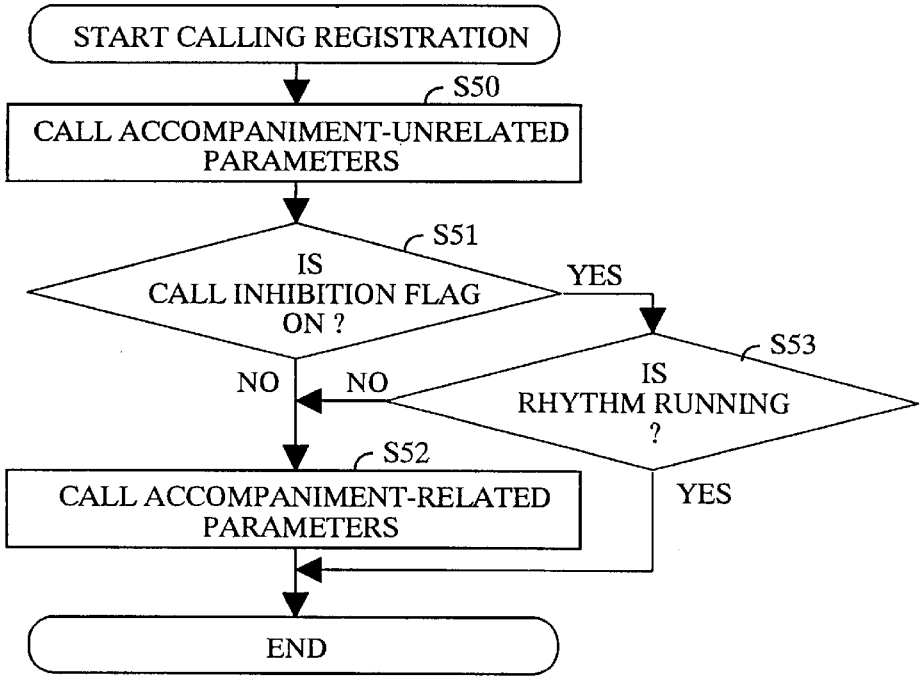
FIG. 9 is a flowchart showing the process of calling registrations in the embodiment of the fourth type of music performing apparatus according to the present invention.

Next, a description will be made about the fourth-type embodiment of the music performing apparatus according to the present invention with reference to the flowchart of FIG. 9 showing the process of calling a registration. The data structure of the registrations in the fourth-type embodiment includes a call inhibition flag for each data set of a registration as shown in FIG. 8. As seen from this figure, there are provided four registration data sets Reg1 through Reg4 as an example, each set including a like set of parameters. The player can selectively call any desired one from among these four registrations for applying to his/her performance. The contents of the registration data are explained hereunder with reference to the registration Reg1 as an example. With respect to the registration which has a call inhibition flag of the "on " condition, if it is called during the music performance using the automatic accompaniment, then only the data other than the accompaniment-related parameters will be read and applied for the panel setting out of the called registration. The on/off condition is to be individually set for each registration by the user arbitrarily. Upon actuation of the registration call switch 13, the registration calling process starts and a step S50 calls an accompaniment-unrelated parameters. Thereafter, a step S51 judges whether or not the call inhibition flag is "on" under which only the data other than the accompaniment-related parameters shall be called when a registration is called during the musical performance using the automatic accompaniment. Where the call inhibition flag is in the "on" condition, the judgement at the step S51 says YES and the process branches to a step S53 to judge whether the automatic rhythm (accompaniment) is running or not. If the rhythm is running, the judgement at the step S53 says YES and as a result the process of calling a registration comes to its end without calling the accompaniment-related parameters. On the other hand, if the rhythm is not running the judgement at the step S53 says NO and as a result the process moves to a step S52 to call the accompaniment-related parameters, and thereafter the process of calling a registration comes to its end. If the step S51 judges that the call inhibition flag is "off", the process moves directly to the step S52 to call the accompaniment-related parameters, and thereafter the process of calling a registration comes to its end.

Thus as explained above, during the musical performance using the automatic accompaniment, when the registration call switch 13 is actuated to selectively call a desired registration from among the stored plurality of registrations, only the data other than the accompaniment-related parameters are read out and applied, if the user has set the call inhibition flag at the "on" condition for the registration under call, and the accompaniment-related parameters will not be called. Where the user has set the call inhibition flag at the "off" condition, both the accompaniment-unrelated parameters and the accompaniment-related parameters will be called whether the automatic accompaniment is being used or not. Thus, the user can selectively set whether to call only the data other than the accompaniment-related parameters or not, and accordingly the player can enjoy a music performance under his/her intended panel setting states while calling registrations during the performance using the automatic accompaniment.

Figure 10:
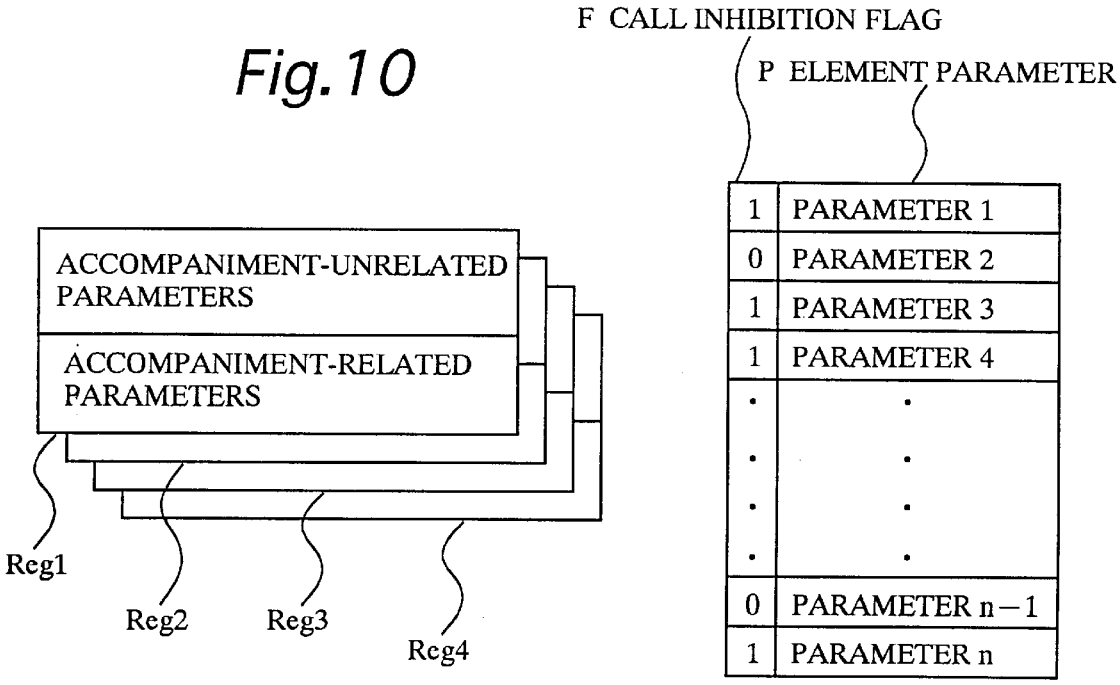
FIG. 10 is a chart showing the data structure of the registrations employed in an embodiment of the fifth type of music performing apparatus according to the present invention.
Figure 11:
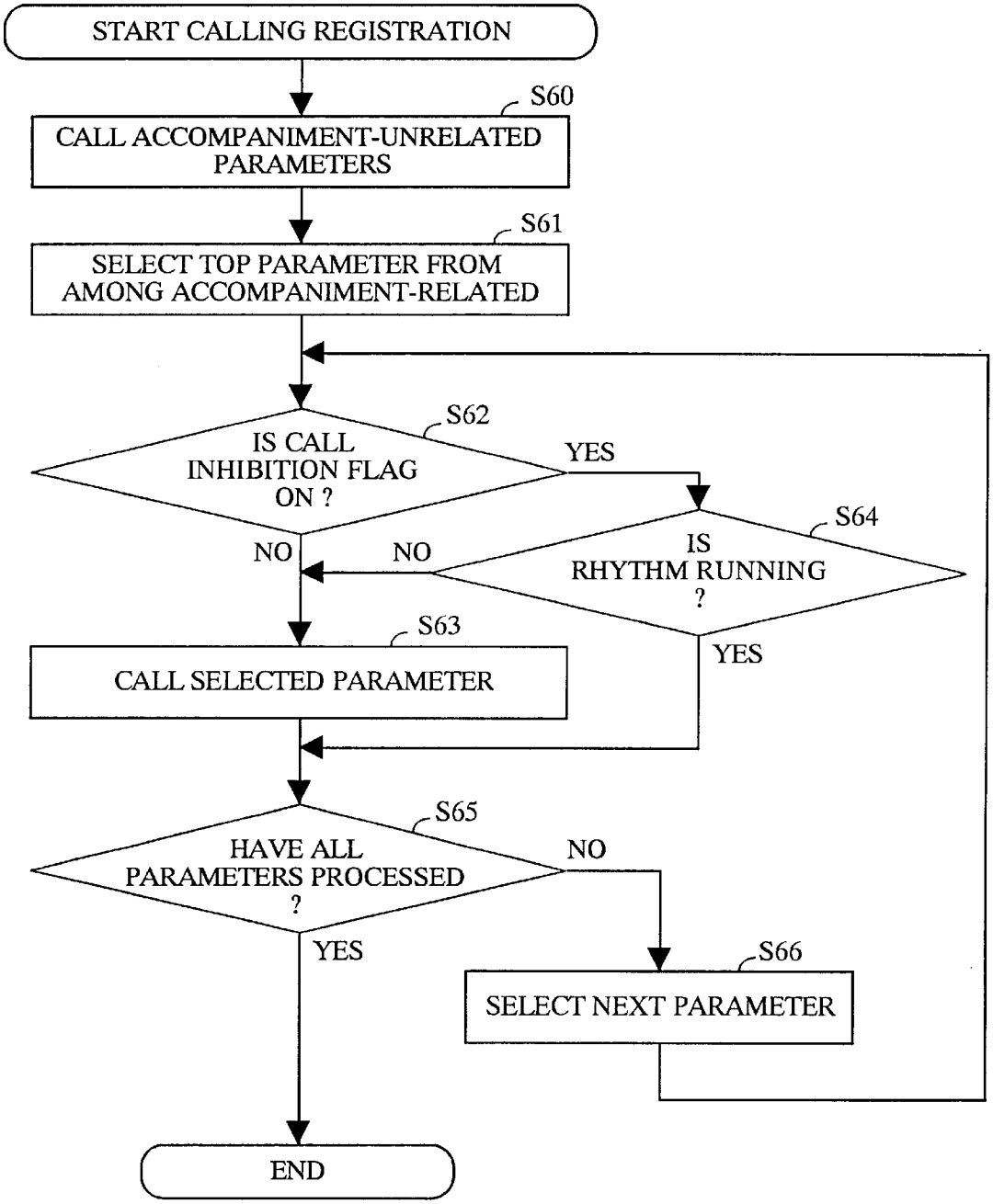
FIG. 11 is a flowchart showing the process of calling registrations in the embodiment of the fifth type of music performing apparatus according to the present invention.

Next, a description will be made about the fifth-type embodiment of the music performing apparatus according to the present invention with reference to the flowchart of FIG. 11 showing the process of calling a registration. As shown in FIG. 10, there are provided four registration data sets Reg1 through Reg4 as an example, each set including a like set of parameters. The player can selectively call any desired one from among these four registrations for applying to his/her performance. The data structure of the registrations in the fifth-type embodiment includes a call inhibition flag F for each element parameter P among the accompaniment-related parameters in each registration as shown in FIG. 10 for the registration Reg1 as an example. When a registration is called during the music performance using the automatic accompaniment, then only the element parameters P other than those of which the corresponding call inhibition flag F is "on" among the accompaniment-related parameters will be read and applied for the panel setting. The on/off condition of the call inhibition flag F is to be individually set for each element parameter P among the accompaniment-related parameters by the user arbitrarily.

Upon actuation of the registration call switch 13, the registration calling process starts and a step S60 calls an accompaniment-unrelated parameters. Thereafter, a step S61 selects the top (first) element parameter P among the accompaniment-related parameters, and next a step S62 judges whether or not the call inhibition flag F corresponding to the selected element parameter P is "on " under which that element parameter P shall not be called when a registration is called during the musical performance using the automatic accompaniment. Where the call inhibition flag F for the top element parameter P is in the "on" condition, the judgement at the step S62 says YES and the process branches to a step S64 to judge whether the automatic rhythm (accompaniment) is running or not. If the rhythm is running, the judgement at the step S64 says YES and as a result the process moves forward to a step S65 without calling the top element parameter P to judge whether all the element parameters have been processed or not. In this instance of the top element parameter P, the processes for all the element parameters have not finished yet, and therefore the process branches to a step S66 to select the next element parameter P before going back to the step S62. On the other hand, if the rhythm is not running, the judgement at the step S64 says NO and as a result the process moves directly to a step S63 to call the currently selected top element parameter before moving to the step S65. If the step S62 judges that the call inhibition flag F for the currently selected element parameter is "off", the process moves directly to the step S63 to call the corresponding element parameter P. Then the process moves to the step S65, and if all the element parameters P have not processed yet, the process flow branches to the step S66 to select the next element parameter P before going back to the step S62. Likewise the above described process flow from the step S62 through the step S66 is repeated about every element parameters in the accompaniment-related parameters. When such a process flow has conducted with respect to all the element parameters, the step S65 judges YES and the process of calling the registration comes to its end.

Thus as explained above, when a registration is called during the musical performance using the automatic accompaniment, only the accompaniment-related parameters whose corresponding call inhibition flag is "on" are prohibited from being read out and applied. On the other hand, the accompaniment-related parameters whose corresponding call inhibition flags are individually set "off" by the user will be called whether or not the automatic accompaniment is currently running.

In this way, during the musical performance using the automatic accompaniment, when the registration call switch 13 is actuated to selectively call a desired registration from among the stored plurality of registrations, only the element parameters P in the accompaniment-related parameters other than the element parameters P whose respectively corresponding call inhibition flags F are set "on" by the user will be called and set in the panel. Thus, the user can selectively set which element parameters to call on a parameter-by-parameter basis, and accordingly the player can enjoy a music performance under his/her intended panel setting state while calling registrations during the performance employing the automatic accompaniment.

Any of the above described five types of embodiments may be employed in combination in a single apparatus according to the present invention. For example, the registration calling rule in the second embodiment in which the accompaniment-related parameters in the preset registrations are prohibited from being called and the parameters in the user-set registrations are always callable and the registration calling rule in the third embodiment in which the call-inhibited mode can be either set or cleared may be combined to make a new registration calling rule in which the accompaniment-related parameters in the preset registrations are prohibited from being called in case the call-inhibited mode is set and are callable in case the call-inhibited mode is cleared whereas the parameters in the user-set registrations are always callable. Alternatively, the registration calling rule in the fourth or fifth embodiment in which the accompaniment-related parameters are prohibited from being called where the call inhibition flag is "on" and the registration calling rule in the third embodiment in which the call-inhibited mode can be either set or cleared may be combined to make another new registration rule in which the accompaniment-related parameters are prohibited from being called if the call inhibition flag is "on" and the cell-inhibited mode is set whereas the parameters are callable if the call-inhibited mode is cleared even though the call inhibition flag is "on", and whereas the parameters are callable as long as the call inhibition flag is "off" even though the call-inhibited mode is set. Although not exemplarily described herein, any combinations with further types of inhibition rules may be possible and available for the present invention.

The kinds of parameters in the registration data may not be limited to those examples illustrated in FIG. 2, and may be more in number or may be less in number than the illustrated examples. Further, some of the parameters illustrated within the "accompaniment-related parameters" may be included in the "accompaniment-unrelated parameters" (i.e. parameters not related to call inhibition) instead. Still further, the registration data may be so designed as to be particularly preferable for the respective accompaniment styles on a style-by-style basis (i.e. the data to define the panel setting state particularly desirable for the music performance using the respective accompaniment styles such as rock, jazz and pops), wherein, however, all or some of the accompaniment-related parameters are to be prohibited from being called when any accompaniment-style-specific registration data may be called during the musical performance using the automatic accompaniment.

The operation of calling a registration data set (i.e. setting the panel switch states) may be conducted by manipulating the corresponding one of the control knobs provided in the panel uniquely corresponding to the respective registration data sets, or may be programmed beforehand to call plurality of registration data sets in sequence according to the designated calling order so as to call the registrations one after another automatically in the designated order (namely, not only the calling order but also the calling timings are to be programmed), or to call the registrations one after another manually in the programmed order by manipulating a uniquely provided predetermined trigger knob (in the latter case, the timings of the respective calls will follow the timings of manipulation of the trigger knob). Further, in case the registrations are to be called by manipulating the control knobs, the registration may be called (altered) at the time the control knob is actuated or may be called in synchronism with the predetermined timings such as the beat timings and the bar line timings in the musical progression of the accompaniment (for example, by waiting for each such timing which comes first after each manipulation of the control knob).

Further, the registration data may not be limited to such data as are inherently stored in the internal storage device ROM 2 and to such data as are inputted to the present apparatus by manipulating the knobs and are stored in the RAM 3, but may be supplied from an external storage device or may be supplied from other MIDI apparatuses 7 or a server computer 10 via the MIDI interface 6 or the communication interface 8.

Further, a music performing apparatus of the present invention may not necessarily be a stand-alone apparatus, but may also be realized in the form of a personal computer plus application software. Such application software may be stored in a magnetic disk, an optical disk, a semiconductor memory and so forth and may be supplied directly to the personal computer or via some network.

Further, a music performing apparatus of the present invention may not necessarily be in the form of a keyboard-type musical instrument, but also may be a stringed musical instrument type, a wind musical instrument type or a percussion musical instrument type. The tone generator device and the automatic accompaniment device may not necessarily be limited to those built in the main body of the music performing apparatus, but also may be separate devices provided outside the main apparatus and may be connected with each other by means of appropriate communication networks or MIDI connection cables.

The tone generator circuit 16 for a music performing apparatus of the present invention may be of any type such as a waveform memory type, an FM synthesis type, a physical model type, a harmonics synthesis type, a formant synthesis type and an analog synthesizer type including the configuration of VCO+VCF+VCA. The tone generator 16 may not necessarily be constructed by an exclusive hardware circuit, but may be constructed by using a DSP+a unique microprogram, or by a CPU+a software program. Further, the tone generator 16 may include a plurality of tone generation channels formed by a time-sharing configuration of a single circuit or may include a plurality of circuits each forming each of the plurality of channels.

A hard disk drive (HDD) which can constitute the external storage device 5 is a storage device for storing control programs and various data. Where the ROM 2 does not store the control programs for the music performing apparatus, the control programs may be stored in the hard disk in the HDD unit and may be loaded into the RAM 3 so that the CPU 1 conducts similar operations as in the case of the ROM 2 which stores the control programs. With such an arrangement, addition or up-grading of the control programs can easily be conducted. A CD-ROM drive which can constitute the external storage device 5 is a device reading out the control programs and various data stored in a detachable CD-ROM. The read out control programs and various data can be stored in the hard disk in the HDD unit so that new installation or up-grading of the control programs can easily be conducted. Other than such a CD-ROM drive, a floppy disk drive, a magneto-optical disk (MO) drive, a DVD (digital versatile disk) drive and other various media drive may be employed for utilizing various detachable storage media.

The communication interface 8 is connected to the communication network 9 such as a LAN (local area network), Internet and a telephone line to be connected to the server computer 10 via the communication network 9. The communication network 9 is used to download the programs and the data from the server computer 10 in case the control programs and various data are not stored in the ROM 2 or the hard disk drive. In such a situation, the music performing apparatus of the present invention is a client to the server computer 10, and transmits a command to the server computer 10 via the communication interface 8 with the communication network 9 requesting the downloading of the programs and the data. The server computer 10 receives the command, and then delivers the requested programs and data to the music performing apparatus of the present invention via the communication network 9. The music performing apparatus of the present invention then receives the delivered programs and data through the communication interface 8 to store in the hard disk drive, thereby completing the downloading procedure.

As will be understood from the above description, according to the embodiment of the first type of music performing apparatus of the present invention, the parameters substantially related to the automatic accompaniment will be automatically excluded from being called and applied to the panel setting and the parameters substantially unrelated to the automatic accompaniment will be called, in case a registration is called while the automatic accompaniment is running. Consequently, even though the user calls a registration for altering the panel setting state in the middle of the music performance employing the automatic accompaniment, an inadvertent and unintended change in the panel setting state for the automatic accompaniment will be avoided without requiring troublesome complicated manipulations.

According to the embodiments of the second through fifth types of music performing apparatus of the present invention, the parameters substantially related to the automatic accompaniment can be prohibited from being called and applied to the panel setting only with respect to the previously preset registrations and the user can arbitrarily select whether the parameters substantially related to the automatic accompaniment are to be called or not. And further, the registration data are so arranged that each registration data set includes a data flag indicating that the parameters substantially related to the automatic accompaniment should be prohibited from being called and applied to the panel setting or not when a registration is called during the music performance employing the automatic accompaniment, or so that each element parameter within the accompaniment-related parameters is paired with a data flag indicating that the paired corresponding element parameter should be prohibited from being called and applied to the panel setting or not, thereby excluding or calling the respective element parameters based on the indication of the corresponding data flags. Therefore, the player can enjoy the music performance according to the panel setting state as intended by himself/herself merely by calling the stored registrations.

The registration data to be used in the present invention may preferably be stored in a machine readable medium for externally supplying such data to the music performing apparatus of the present invention. The data stored in the medium includes comprehensive call inhibition information indicating whether the accompaniment-related parameters in the called registration as a whole are to be called or not, or individual call inhibition information indicating whether the individual element parameters in the accompaniment-related parameters in the called registration are to be called or not on an element-by-element basis, and accordingly, when registration data are called, the accompaniment parameters as a whole or individually designated by the call inhibition information will be prohibited from being called and applied to the panel setting. Therefore, by setting the storage medium containing the registration data according to the present invention to the medium reader of the music performing apparatus of the present invention and thereafter commanding the call of the stored registration data, the music performing apparatus automatically judges whether the accompaniment-related parameters as a whole or the individual element parameters thereof should be called or not. Thus, the player can enjoy the musical performance with his/her intended panel setting state by taking out the registration from the storage medium containing the registration data of the present invention.

The invention is not limited to a music performing apparatus of an integrated form comprising in itself the enumerated element devices as shown in FIG. 1, but may be applied to a system constituted by separate element devices connected together to configure the music performing apparatus of the present invention in combination. Also various manners of technology prevailing in the computer field may also be available.

While several forms of the invention have been shown and described, other forms will be apparent to those skilled in the art without departing from the spirit of the invention. Therefore, it should be understood that the embodiments shown in the drawings and described above are merely for illustrative purposes, and are not intended to limit the scope of the invention, which is defined by the appended claims.

What is claimed is:

1. A music performing apparatus comprising:

a manipulative music performing device which performs music according to manipulative operations by a user to play music on the apparatus;

an automatic accompaniment performing device which performs musical accompaniment according to automatically progressing rhythm signals;

a data storage device which stores at least one registration data set each set including a first data subset which represents first parameters for defining registrations substantially related to musical performance other than the automatic accompaniment, and a second data subset which represents second parameters for defining registrations substantially related to the automatic accompaniment, said first parameters substantially determining properties and manners of musical performance other than the automatic accompaniment and said second parameters substantially determining properties and manners of automatic accompaniment;

a parameter supplying device which supplies said first and second parameters to said manipulative music performing device and said automotive accompaniment performing device, respectively, to render said manipulative music performing device operative to perform music with the properties and manners determined by said first parameters, and to render said automatic accompaniment performing device operative to perform musical accompaniment with the properties and manners determined by said second parameters;

a judging device which judges whether an automatic accompaniment performance is now running or not;

a registration call instructing device for inputting an instruction to selectively call one of said at least one registration data set; and a registration calling device which reads and sends said selected registration data set from said data storage device to said parameter supplying device upon instruction of the registration call, such that the registration calling device sends only said first data subset to the parameter supplying device, when said judging device judges that an automatic accompaniment performance is running now.

2. A music performing apparatus as claimed in claim 1, wherein said data storage device stores a plurality of registration data sets as said at least one registration data set; and said registration call instruction device is capable of selecting one registration data set according to the user's selection from among said plurality of registration data sets.

3. A music performing apparatus as claimed in claim 1, further comprising:

a registration call programming device which programs a sequence of registration data sets to be called from among said plurality of registration data sets in the order of calls; and wherein said registration call instructing device calls registration data sets in the order of said sequence as programmed in said registration call programming device.

4. A music performing apparatus comprising:

a manipulative music performing device which performs music according to manipulative operations by a user to play music on the apparatus;

an automatic accompaniment performing device which performs musical accompaniment according to automatically progressing rhythm signals;

a registration data setting device for setting at least one user-set registration data set by the user of the apparatus, each set including a first data subset which represents first parameters for defining registrations substantially related to musical performance other than the automatic accompaniment, and a second data subset which represents second parameters for defining registrations substantially related to the automatic accompaniment, said first parameters substantially determining properties and manners of musical performance other than the automatic accompaniment and said second parameters substantially determining properties and manners of automatic accompaniment;

a data storage device which stores said at least one user-set registration data set which is set by said registration data setting device, and further stores at least one preset registration data set which is preset in the apparatus each set including a third data subset which represents third parameters for defining registration substantially related to musical performance other than the automatic accompaniment, and a fourth data subset which represents fourth parameters for defining registrations substantially related to the automatic accompaniment, said third parameters substantially determining properties and manners of musical performance other than the automatic accompaniment and said fourth parameters substantially determining properties and manners of automatic accompaniment;

a parameter supplying device which supplies said first and second parameters or said third and fourth parameters to said manipulative music performing device and said automatic accompaniment performing device, respectively, to render said manipulative music performing device operative to perform music with the properties and manners determined by said first or third parameters, and to render said automatic accompaniment performing device operative to perform musical accompaniment with the properties and manners determined by said second or fourth parameters;

a registration call instructing device for inputting an instruction to selectively one of said at least one user-set registration data set or said at least one preset registration data set;

a judging device which judges whether said selectively called registration data set is a preset registration data set or not; and a registration calling device which reads and sends said selected registration data set from said data storage device to said parameter supplying device upon instruction of the registration call, such that the registration calling device sends said first and second data subsets to the parameter supplying device, when said judging device judges that the selectively called registration data set is not a preset registration data set.

5. A music performing apparatus as claimed in claim 4, further comprising:

a second judging device for judging whether an automatic accompaniment performance is now running or not; and wherein said registration calling device sends only said third data subset to the parameter supplying device, when said first mentioned judging device judges that said selectively called registration data set is a preset registration data set and said second judging device judges that an automatic accompaniment performance is running now, whereas said registration calling device sends both said third and fourth data subsets to the parameter supplying device, when said first mentioned judging device judges that said selectively called registration data set is a preset registration data set and said second judging device judges that an automatic accompaniment performance is not running now.

6. A music performing apparatus as claimed in claim 4, wherein said data storage device stores a plurality of registration data sets as said at least one registration data set; and said registration call instructing device is capable of selecting one registration data set according to the user's selection from among said plurality of registration data sets.

7. A music performing apparatus as claimed in claim 4, further comprising:

a registration call programming device which programs a sequence of registration data sets to be called from among said plurality of registration data sets in the order of calls; and wherein said registration call instructing device calls registration data sets in the order of said sequence as programmed in said registration call programming device.

8. A music performing apparatus comprising:

a manipulative music performing device which performs music according to manipulative operations by a user to play music on the apparatus;

an automatic accompaniment performing device which performs musical accompaniment according to automatically progressing rhythm signals;

a data storage device which stores at least one registration data set each set including a first data subset which represents first parameters for defining registrations substantially related to musical performance other than the automatic accompaniment, and a second data subset which represents second parameters for defining registrations substantially related to the automatic accompaniment, said first parameters substantially determining properties and manners of musical performance other than the automatic accompaniment and said second parameters substantially determining properties and manners of automatic equipment;

a parameter supplying device which supplies said first and second parameters to said manipulative music performing device and said automatic accompaniment performing device, respectively, to render said manipulative music performing device operative to perform music with the properties and manners determined by said first parameters, and to render said automatic accompaniment performing device operative to perform musical accompaniment with the properties and manners determined by said second parameters;

a mode setting device for selectively setting a call-inhibited mode in which said second data subset shall not be called;

a judging device for judging whether said call-inhibited mode is set or not;

a registration call instructing device for inputting an instruction to selectively call one of said at least one registration data set; and a registration calling device which reads and sends said selected registration data set from said data storage device to said parameter supplying device upon instruction of the registration call, such that the registration calling device sends said first and second data subsets to the parameter supplying device, when said judging device judges that said call-inhibited mode is not set.

9. A music performing apparatus as claimed in claim 8, further comprising:

a second judging device for judging whether an automatic accompaniment performance is now running or not; and wherein said registration calling device sends only said first data subset to the parameter supplying device, when said first mentioned judging device judges that said call-inhibited mode is set and said second judging device judges that an automatic accompaniment performance is running now, whereas said registration calling device sends both said first and second data subsets to the parameter supplying device, when said first mentioned judging device judges that said call-inhibited mode is set and said second judging device judges that an automatic accompaniment performance is not running now.

10. A music performing apparatus as claimed in claim 8, wherein said data storage device stores a plurality of registration data sets as said at least one registration data set; and said registration call instructing device is capable of selecting one registration data set according to the user's selection from among said plurality of registration data sets.

11. A music performing apparatus as claimed in claim 8, further comprising:

a registration call programming device which programs a sequence of registration data sets to be called from among said plurality of registration data sets in the order of calls; and wherein said registration call instructing device calls registration data sets in the order of said sequence as programmed in said registration call programming device.

12. A music performing apparatus comprising:

a manipulative music performing device which performs music according to manipulative operations by a user to play music on the apparatus;

an automatic accompaniment performing device which performs musical accompaniment according to automatically progressing rhythm signals;

a data storage device which stores at least one registration data set each set including a first data subset which represents first parameters for defining registrations substantially related to musical performance other than the automatic accompaniment, a second data subset which represents second parameters for defining registrations substantially related to the automatic accompaniment, and a data flag which indicates whether said second data subset shall be called or not, said first parameters substantially determining properties and manners of musical performance other than the automatic accompaniment and said second parameters substantially determining properties and manners of automatic accompaniment;

a parameter supplying device which supplies said first and second parameters to said manipulative music performing device and said automatic accompaniment performing device, respectively, to render said manipulative music performing device operative to perform music with the properties and manners determined by said first parameters, and to render said automatic accompaniment performing device operative to perform musical accompaniment with the properties and manners determined by said second parameters;

a judging device for judging whether said data flag indicates that said second data subset shall be called or not;

a registration call instructing device for inputting an instruction to selectively call one of said at least one registration data set; and a registration calling device which reads and sends said selected registration data set from said data storage device to said parameter supplying device upon instruction of the registration call, such that the registration calling device sends both said first and second data subsets to the parameter supplying device, when said judging device judges that said data flag indicates that said second data subset shall be called.

13. A music performing apparatus as claimed in claim 12, further comprising:

a second judging device for judging whether an automatic accompaniment performance is now running or not; and wherein said registration calling device sends only said first data subset to the parameter supplying device, when said first mentioned judging device judges that said data flag indicates that said second data subset shall not be called and said second judging device judges that an automatic accompaniment performance is running now, whereas said registration calling device sends both said first and second data subsets to the parameter supplying device, when said first mentioned judging device judges that said data flag indicates that said second data subset shall not be called but said second judging device judges that an automatic accompaniment performance is not running now.

14. A music performing apparatus as claimed in claim 12, wherein said data storage device stores a plurality of registration data sets as said at least one registration data set; and said registration call instructing device is capable of selecting one registration data set according to the user's selection from among said plurality of registration data sets.

15. A music performing apparatus as claimed in claim 12, further comprising:

a registration call programming device which programs a sequence of registration data sets to be called from among said plurality of registration data sets in the order of calls; and wherein said registration call instructing device calls registration data sets in the order of said sequence as programmed in said registration call programming device.

16. A music performing apparatus as claimed in claim 12, wherein said data flag is rewritable by the user in terms of indication of whether said second data subset shall be called or not.

17. A music performing apparatus comprising:

a manipulative music performing device which performs music according to manipulative operations by a user to play music on the apparatus;

an automatic accompaniment performing device which performs musical accompaniment according to automatically progressing rhythm signals;

a data storage device which stores at least one registration data set each set including a first data subset which represents first parameters for defining registrations substantially related to musical performance other than the automatic accompaniment, a second data subset which represents second parameters for defining registrations substantially related to the automatic accompaniment, and a third data subset including data flags each of which corresponds to each of said second parameters and indicates whether the corresponding parameter shall be called or not, said first parameters substantially determining properties and manners of musical performance other than the automatic accompaniment and said second parameters substantially determining properties and manners of automatic accompaniment;

a parameter supplying device which supplies said first and second parameters to said manipulative music performing device and said automatic accompaniment performing device, respectively, to render said manipulative music performing device operative to perform music with the properties and manners determined by said first parameters, and to render said automatic accompaniment performing device operative to perform musical accompaniment with the properties and manners determined by said second parameters;

a judging device for judging whether each said data flag indicates that each said corresponding second parameter shall be called or not;

a registration call instructing device for inputting an instruction to selectively call one of said at least one registration data set; and a registration calling device which reads and sends said selected registration data set from said data storage device to said parameter supplying device upon instruction of the registration call, such that the registration calling device sends to the parameter supplying device both said first and second data subset, when said judging device judges that none of said data flags indicate that the corresponding second parameter shall not be called.

18. A music performing apparatus as claimed in claim 17, further comprising:

a second judging device for judging whether an automatic accompaniment performance is now running or not; and wherein said registration calling device sends said first and second data subset except for the data representing each second parameter which is indicated by the corresponding data flag in said third data subset so as not to be called based on the judgment by said first mentioned judging device, when said second judging device judges that an automatic accompaniment performance is running now, whereas said registration calling device sends both said first and second data subsets to the parameter supplying device, when said second judging device judges that an automatic accompaniment performance is not running now, even though said first mentioned judging device judges that any of said data flags indicates that the corresponding parameter in said second data subset shall not be called.

19. A music performing apparatus as claimed in claim 17, wherein said data storage device stores a plurality of registration data sets as said at least one registration data set; and said registration call instructing device is capable of selecting one registration data set according to the user's selection from among said plurality of registration data sets.

20. A music performing apparatus as claimed in claim 17, further comprising:

a registration call programming device which programs a sequence of registration device sets to be called from among said plurality of registration data sets in the order of calls; and wherein said registration call instructing device calls registration data sets in the order of said sequence as programmed in said registration call programming device.

21. A music performing apparatus as claimed in claim 17, wherein each of said data flags included in said third data subset is rewritable by the user in terms of indication of whether each corresponding parameter in said second data subset shall be called or not.

22. An electronic musical apparatus using a computer system to configure the computer system to construct the electronic musical apparatus according to computer program instructions applied thereto, said electronic musical apparatus comprising:

a music performing device which performs music according to musical performance signals;

an automatic accompaniment performing device which performs musical accompaniment according to automatically progressing rhythm signals;

a data storage device which stores at least one registration data set each set including a first data subset which represents first parameters for defining registrations substantially related to musical performance other than the automatic accompaniment, and a second data subset which represents second parameters for defining registrations substantially related to the automatic accompaniment, said first parameters substantially determining at least one of properties and manners of musical performance other than the automatic accompaniment and said second parameters substantially determining at least one of properties and manners of automatic accompaniment;

a parameter supplying device which supplies said first and second parameters to said music performing device and said automatic accompaniment performing device, respectively, to render said music performing device operative to perform music with at least one of the properties and manners determined by said first parameters, and to render said automatic accompaniment performing device operative to perform musical accompaniment with at least one of the properties and manners determined by said second parameters;

a judging device which judges whether an automatic accompaniment performance is now running or not;

a registration call instructing device for inputting an instruction to selectively call one of said at least one registration data set; and a registration calling device which reads and sends said selected registration data set from said data storage device to said parameter supplying device upon instruction of the registration call, wherein the registration calling device sends only said first data subset to the parameter supplying device, when said judging device judges that an automatic accompaniment performance is running now.

23. A music performing apparatus comprising:

manipulative music performing means for performing music according to manipulative operations by a user to play music on the apparatus;

automatic accompaniment performing means for performing musical accompaniment according to automatically progressing rhythm signals;

data storage means for storing at least one registration data set each set including a first data subset which represents first parameters for defining registrations substantially related to musical performance other than the automatic accompaniment, and a second data subset which represents second parameters for defining registrations substantially related to the automatic accompaniment, said first parameters substantially determining properties and manners of musical performance other than the automatic accompaniment and said second parameters substantially determining properties and manners of automatic accompaniment;

parameter supplying means for supplying said first and second parameters to said manipulative music performing means and said automatic accompaniment performing means, respectively, to render said manipulative music performing means operative to perform music with the properties and manners determined by said first parameters, and to render said automatic accompaniment performing means operative to perform musical accompaniment with the properties and manners determined by said second parameters;

judging means which judges whether an automatic accompaniment performance is now running or not;

registration call instructing means for inputting an instruction to selectively call one of said at least one registration data set; and registration calling means for reading and sending said selected registration data set from said data storage means to said parameters supplying means upon instruction of the registration call, such that the registration calling means sends only said first data subset to the parameter supplying means, when said judging means judges that an automatic accompaniment performance is running now.

24. A method of performing music by calling registrations to determine properties and manners of musical performance, said method comprising the steps of:

providing a manipulative music performing device which performs music according to manipulative operations by a user to play music on the computer system;

providing an automatic accompaniment performing device which performs musical accompaniment according to automatically progressing rhythm signals;

storing at least one registration data set each set including a first data subset which represents first parameters for defining registrations substantially related to musical performance other than the automatic accompaniment, and a second data subset which represents second parameters for defining registrations substantially related to the automatic accompaniment, said first parameters substantially determining properties and manners of musical performance other than the automatic accompaniment and said second parameters substantially determining properties and manners of automatic accompaniment;

supplying said first and second parameters to said manipulative music performing device and said automatic accompaniment performing device, respectively, to render said manipulative music performing device operative to perform music with the properties and manners determined by said first parameters, and to render said automatic accompaniment performing device operative to perform musical accompaniment with the properties and manners determined by said second parameters;

judging whether an automatic accompaniment performance is now running or not;

providing a registration call instructing device for inputting an instruction to selectively call one of said at least one registration data set according to the user's selection; and reading and sending said selected registration data set from said data storage device to said parameter supplying process upon instruction of the registration call, such that said first data subset is supplied to said manipulative music performing device only and that said second data subset is not supplied to said automatic accompaniment performing device, when said judging process judges that an automatic accompaniment performance is running now.

25. A machine readable medium containing program instructions for use in a computer system to configure the computer system upon being read and executed by the computer system to perform the processes of:

providing a manipulative music performing device which performs music according to manipulative operations by a user to play music on the computer system;

providing an automatic accompaniment performing device which performs musical accompaniment according to automatically progressing rhythm signals;

storing at least one registration data set each set including a first data subset which represents first parameters for defining registrations substantially related to musical performance other than the automatic accompaniment, and a second data subset which represents second parameters for defining registrations substantially related to the automatic accompaniment, said first parameters substantially determining properties and manners of musical performance other than the automatic accompaniment and said second parameters substantially determining properties and manners of automatic accompaniment;

supplying said first and second parameters to said manipulative music performing device and said automatic accompaniment performing device, respectively, to render said manipulative music performing device operative to perform music with the properties and manners determined by said first parameters, and to render said automatic accompaniment performing device operative to perform musical accompaniment with the properties and manners determined by said second parameters;

judging whether an automatic accompaniment performance is now running or not;

providing a registration call instructing device for inputting an instruction to selectively call one of said at least one registration data set according to the user's selection; and reading and sending said selected registration data set from said data storage device to said parameter supplying process upon instruction of the registration call, such that said first data subset is supplied to said manipulative music performing device only and that said second data subset is not supplied to said automatic accompaniment performing device, when said judging process judges that an automatic accompaniment performance is running now.

* * * * *